US010604163B2

(12) United States Patent
Souchal

(10) Patent No.: US 10,604,163 B2
(45) Date of Patent: Mar. 31, 2020

(54) DEVICE AND METHOD FOR REPOSITIONING THE CARRYING CABLE OF A CABLEWAY INSTALLATION

(71) Applicant: POMA, Voreppe (FR)

(72) Inventor: Jean Souchal, Grenoble (FR)

(73) Assignee: POMA, Voreppe (FR)

( * ) Notice: Subject to any disclaimer, the term of this patent is extended or adjusted under 35 U.S.C. 154(b) by 387 days.

(21) Appl. No.: 15/724,737

(22) Filed: Oct. 4, 2017

(65) Prior Publication Data

US 2018/0105187 A1 Apr. 19, 2018

(30) Foreign Application Priority Data

Oct. 17, 2016 (FR) ..... 16 60026

(51) Int. Cl.

| | |
|---|---|
| ***B61B 12/08*** | (2006.01) |
| ***B61B 12/02*** | (2006.01) |
| ***B61B 12/06*** | (2006.01) |
| ***B61B 12/00*** | (2006.01) |
| ***E01B 25/18*** | (2006.01) |
| ***E01B 25/16*** | (2006.01) |
| ***B61B 7/00*** | (2006.01) |
| ***B61B 12/12*** | (2006.01) |

(52) U.S. Cl.

CPC ..... *B61B 12/08* (2013.01); *B61B 7/00* (2013.01); *B61B 12/007* (2013.01); *B61B 12/026* (2013.01); *B61B 12/06* (2013.01); *B61B 12/127* (2013.01); *E01B 25/16* (2013.01); *E01B 25/18* (2013.01)

(58) Field of Classification Search

CPC ..... B61B 7/00; B61B 7/04; B61B 12/007; B61B 12/06; B61B 12/08; B61B 12/127; B05C 5/0241; B05C 11/021; E01B 25/16; E01B 25/18

USPC ..... 104/173.1, 173.2, 180, 198, 199

See application file for complete search history.

(56) References Cited

U.S. PATENT DOCUMENTS

| | | | | |
|---|---|---|---|---|
| 1,384,848 A * | 7/1921 | Pierson | B61B 12/08 | 104/251 |
| 3,530,526 A * | 9/1970 | Schmidt | D07B 7/12 | 15/302 |
| 4,591,390 A * | 5/1986 | Scott | B08B 3/024 | 134/15 |
| 4,982,473 A * | 1/1991 | Farris | B08B 1/02 | 15/256.6 |
| 5,655,457 A * | 8/1997 | Sherman | B61B 7/00 | 104/123 |

(Continued)

FOREIGN PATENT DOCUMENTS

| | | | |
|---|---|---|---|
| CA | 2659136 A1 | 10/2009 | |
| DE | 3937927 A1 * | 5/1991 | B61B 12/00 |

(Continued)

*Primary Examiner* — Zachary L Kuhfuss

(74) *Attorney, Agent, or Firm* — Oliff PLC

(57) ABSTRACT

Cableway installation, including at least one carrying cable supported by support blocks provided in the terminals, and actuating device for repositioning the carrying cable to periodically renew the surface directly in contact with the support blocks, wherein the actuating device is configured so as to make said carrying cable rotate on itself by angularly modifying the contact area according to the profile of the housing groove of the support blocks.

12 Claims, 3 Drawing Sheets

(56) References Cited

U.S. PATENT DOCUMENTS

| | | | | |
|---|---|---|---|---|
| 7,880,633 | B2 * | 2/2011 | Thum | B61B 12/06 212/276 |
| 8,166,886 | B2 * | 5/2012 | Thum | B61B 12/06 104/112 |
| 2006/0068085 | A1 * | 3/2006 | Reece | H01B 3/22 427/117 |
| 2008/0296096 | A1 * | 12/2008 | Bertrand | B61B 12/02 187/266 |
| 2009/0189131 | A1 * | 7/2009 | Brun | B61B 12/00 254/133 R |
| 2018/0105187 | A1 * | 4/2018 | Souchal | B61B 12/026 |
| 2018/0331516 | A1 * | 11/2018 | Temple | G01N 21/952 |

FOREIGN PATENT DOCUMENTS

| | | | |
|---|---|---|---|
| EP | 2108559 | A1 | 10/2009 |
| FR | 2935945 | A1 | 3/2010 |
| JP | 2002-145050 | A | 5/2002 |

* cited by examiner

DEVICE AND METHOD FOR REPOSITIONING THE CARRYING CABLE OF A CABLEWAY INSTALLATION

BACKGROUND OF THE INVENTION

The invention relates to a cableway transport installation, in particular of the bicable type, commonly referred to as back and force, back or force, or detachable cable car, or of self-propelled transfer cableway type, the installation comprising a line with one or more carrying cables on which the vehicle(s) roll(s).

This type of installation comprises terminals in which the carrying cable(s) is(are) anchored. They are in general guided on exit from the terminal on supports called "blocks". On the line, depending on the configuration of the ground and of the installation, these carrying cables are also supported and guided on blocks arranged at the top of one or more line pillars.

The carrying cables are static, but the path of the vehicle(s) on the line causes movements of the cables inducing flexions accompanied by variations of bow and of sliding at the level of their supports. The passages of vehicles on the blocks, with more or less heavy loads per roller, create internal stresses in the cables. Consequently, all of these cable pressing points (on the line and in the terminal) are greased. This results in a better sliding of the carrying cables on the blocks and protection of their internal structure, thereby preserving their lifespan.

The pressing point areas of these carrying cables on entrance to and exit from the blocks represent areas sensitive to fatigue and damage. To limit the wear and damage of these carrying cables caused by the repeated passage of the vehicles in these areas, the standards and specifications of the manufacturers require the carrying cables to be periodically moved on their supports. The frequency of inspection of the carrying cables on terminal or line blocks can range from 6 to 12 years, depending on the type of equipment. For carrying cables subjected to large stresses, this frequency may be reduced.

It is known that repositioning of the carrying cables on the support blocks is performed by longitudinal sliding by exerting a pull on the cable from a reserve of cable, which is situated in one of the terminals. The repositioning length has to be at least equal to that of the contact area of the carrying cable on the support, increased by a safety length. The reserve of cable is generally formed by a rotary drum on which a few spirals of cable are wound. The reserve assembly has to withstand the mechanical strain of the carrying cable and requires a support structure solidly anchored to the ground of the terminal.

OBJECT OF THE INVENTION

The object of the invention consists in providing a transfer installation rolling on at least one aerial carrying cable, repositioning of which on the blocks of terminals and lines does not require any reserve of cable in the terminals.

The installation according to the invention comprises:

- at least one carrying cable on which the vehicle rolls along the line between two terminals,
- support blocks provided in the terminals for supporting and guiding of the carrying cable,
- and means for repositioning the carrying cable to periodically renew the surface directly in contact with the support blocks, characterized in that the means for repositioning the carrying cable are configured to make said cable rotate on itself by angularly modifying the contact area according to the profile of the housing groove of the support blocks.

Preferably, the angle of rotation for repositioning of the carrying cable is comprised between 90° and 180°.

According to one feature of the invention, the carrying cable is a closed cable of circular cross-section, partially salient from the housing groove and pressing on a contact area in the form of an arc of a circle of each support block.

According to a preferential embodiment, repositioning of the carrying cable is performed by means of a hydraulic, or mechanical or electromechanical actuating device, which is arranged in the terminals to produce the necessary torque for partial rotation of the cable.

The actuating device comprises a system of jaws or other gripping means for clamping the carrying cable, said system being fixed on a toothed wheel engaging with a pinion controlled by a mechanism. The carrying cable passes through the jaw system and is connected to an anchorage, which is configured to be free in rotation on itself during the angular repositioning operation.

The invention also relates to the method for repositioning the cable comprising:

- keeping the carrying cable taut during repositioning,
- making each end of said carrying cable rotate on its axis with an angle comprised between 90° and 180° to renew the contact area with the housing groove of the support and guide blocks,
- and monitoring the angular movement of said cable in each terminal.

The invention applies to any type of bicable carrying and hauling cable car, for example 2S or 3S, or a cableway with a self-propelled system, requiring repositioning of the carrying cable(s) on the blocks at predefined intervals according to the number of passages of vehicles.

BRIEF DESCRIPTION OF THE DRAWINGS

Other advantages and features will become more clearly apparent from the following description of an embodiment of the invention given for non-restrictive example purposes only and represented in the appended drawings in which.

DESCRIPTION OF A PARTICULAR EMBODIMENT

Figure 1:
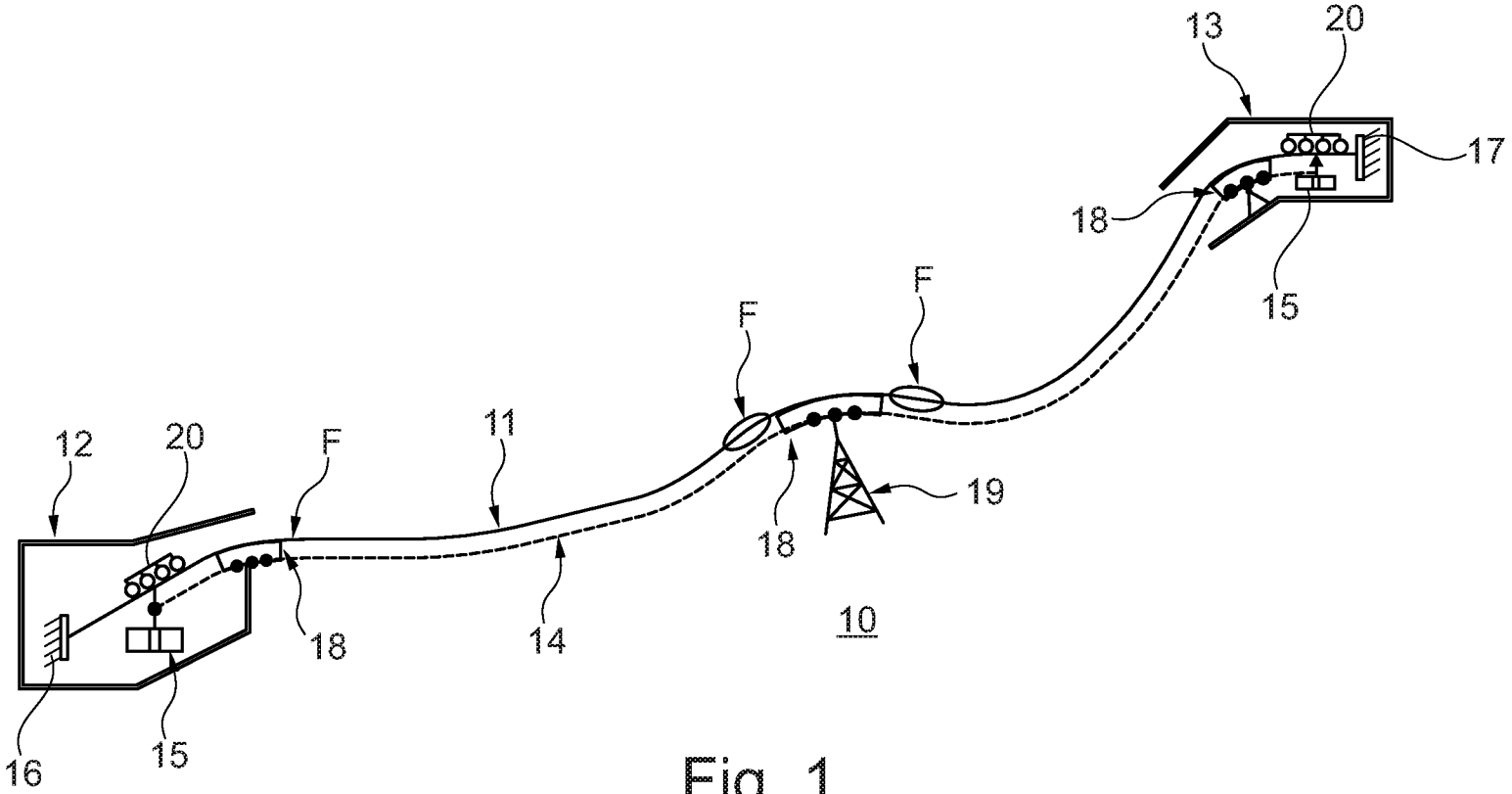
FIG. 1 is a schematic view of a bicable transport installation between two terminals.

With reference to FIG. 1, an aerial cableway installation 10, of passenger transfer or back and force, back or force, or detachable cable car type, comprises at least one static carrying cable 11 extending along the line between two terminals 12, 13, and a hauling cable 14 coupled to the vehicles 15 for movement of the latter along the transport line.

The carrying cable 11 is secured via its two ends to anchorages 16, 17 fixed in the terminals 12, 13. It is placed under mechanical tension and anchored so as to remain taut when the rollers of the carriage 20 of the vehicles 15 roll on it along the line.

Guiding and support of the carrying cable 11 are performed by means of support blocks 18 provided on entrance to or exit from the terminals 12, 13, and on the top of one or more line pillars 19.

The hauling cable 14 of the vehicles 15 is represented in a broken line. It rolls along the carrying cable 11 with a certain offset, and forms part of a drive group with a drive wheel and a return wheel (not shown). The hauling cable 14 is kept taut, for example by a counterweight or hydraulic jacks.

In the case of a variance of a transfer cableway making use of a self-propelled system for driving the vehicle, the hauling cable is eliminated on account of the fact that the vehicle is self-hauled in autonomous manner rolling on the carrying cable.

Flexion areas F may appear on entrance to and exit from the support blocks 18 following the repeated passages of the vehicles 15. To limit the wear and damage of the carrying cable 11, the latter is moved periodically according to the number of passages of the vehicles, for example every 6 to 12 years, to modify and renew the surface directly in contact and in engagement with the support blocks 18.

Figure 2:
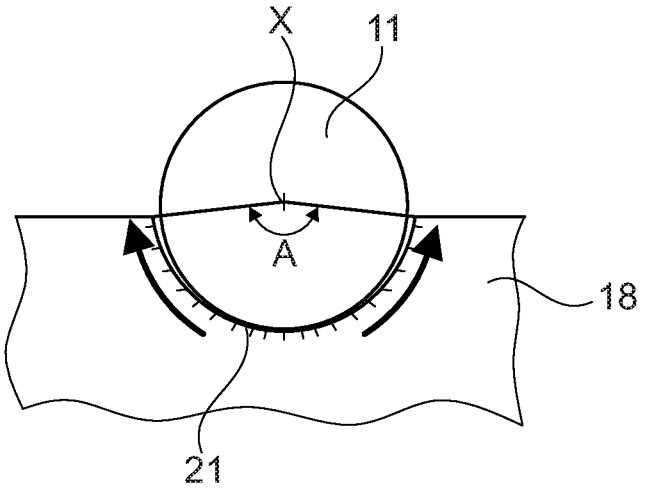
FIG. 2 shows a transverse cross-sectional view of the carrying cable housed in a groove of a support and guide block.

FIG. 2 shows guiding of the carrying cable 11 in a substantially semi-circular housing groove 21 situated at the top part of the support block 18. The carrying cable 11 used is a closed cable, i.e. of circular cross-section with a smooth external surface, without apparent strands. It is partially salient from the housing groove 21 and presses on a contact area in the form of an arc of a circle forming an angle A of less than 180°.

According to the invention, the transport installation 10 is equipped with an actuating device 22 (FIGS. 5 and 6) to make the carrying cable 11 rotate so as to perform angular repositioning of the latter at the level of the contact area of the support blocks 18. This repositioning modifies the position of the area in contact between the closed carrying cable 11 and the housing groove 21 of the block in circular manner.

Figure 3:
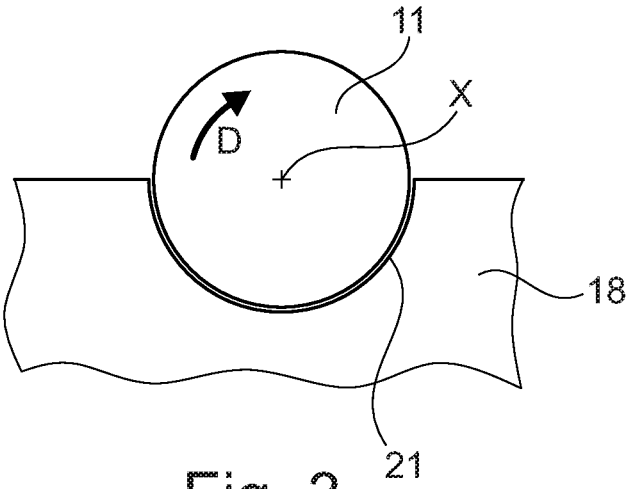
FIG. 3 is an identical view to FIG. 2 after angular repositioning of the carrying cable.

To perform this modification of pressing of the surfaces in contact of the carrying cable 11, said cable is rotated on its X-axis in the direction of arrow D (FIG. 3). This results in a rotational movement of sufficient course so as to angularly displace the contact area of said cable with the block 18. The angle of rotation can be situated between 90° and 180° according to the profiles of the housing grooves 21 of the blocks 18.

Figure 4:
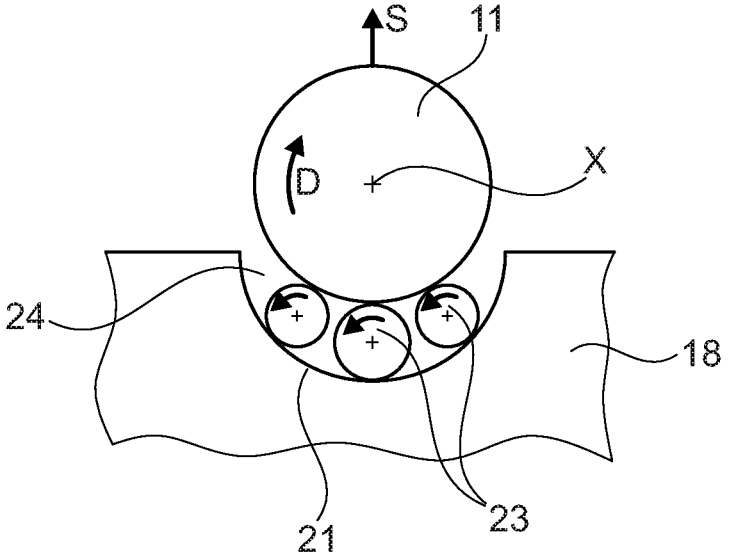
FIG. 4 represents a variant of FIG. 3 after the cable has been raised and rolling means have been inserted under the cable to facilitate its rotation on itself.

Before performing this partial rotation of the carrying cable 11 on itself, the latter can be raised slightly (arrow S) for staggering it from the bottom of the housing groove 21. Rolling means 23, in particular rollers or roller needles, can be inserted in the separating gap 24 to facilitate its rotation (FIG. 4). Repositioning in rotation of the closed carrying cable 11 is performed from the terminals 12, 13, in simultaneous manner or not.

The actuating device 22 for performing rotation can be arranged in the terminals 12, 13, near to the support blocks 18, to facilitate rotation of the carrying cable 11 and monitoring of the angle of rotation. Throughout the operation, the carrying cable 11 is kept taut in the terminals 12, 13 so as to limit its movements and sliding on the support blocks 18. The support block areas are indicated by marking of the cable 11 to be handled, in order to monitor its angular movement in the housing groove 21 of their support blocks.

Figure 5:
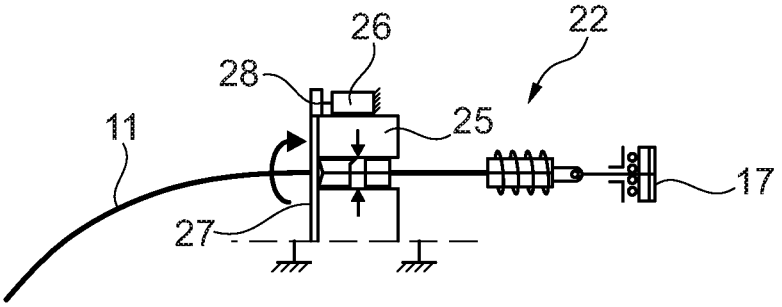
FIG. 5 is a schematic view of the actuation device of the carrying cable in rotation, the latter being illustrated in the form of a simple wire.
Figure 6:
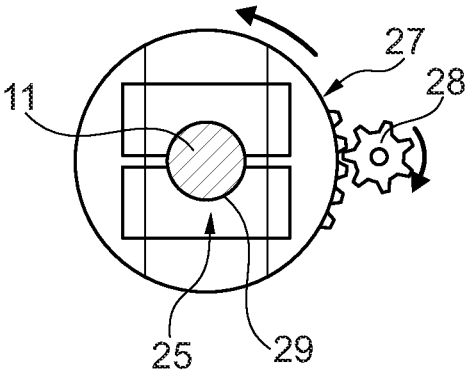
FIG. 6 is an enlarged scale side view of FIG. 5.

In FIGS. 5 and 6, the actuating device 22 is composed for example of a system of jaws 25 clamped on the carrying cable 11 and driven in rotation by a hydraulic or mechanical or electromechanical mechanism 26 in order to produce the necessary torque. Rotation will take place slowly to prevent any abrupt and violent movement of the cable 11.

The jaw system 25 is fixed on a toothed wheel 27 engaging with a pinion 28 of the mechanism 26. The toothed wheel 27 is provided with a central aperture 29 for passage of the carrying cable 11, which is clamped by the jaw system 25, extending towards the anchorage 17.

The jaw system 25 can naturally be replaced by any other gripping means of the cable 11.

The anchorage 17 of FIG. 5 is configured to leave its rotation on itself free during the angular repositioning operation where the cable 11 has to remain taut.

To prevent any damage to the carrying cable 11, the repositioning in rotation movement is performed in the direction compatible with that of the thread of cabling of the closed cable.

The invention is naturally also applicable to a transport installation comprising two carrying cables, for example of the 3S type, i.e. having two carrying cables and a hauling cable. In this case, the repositioning method will be performed on both of the carrying cables.

The invention is also applicable to transfer cableways equipped with a self-propelled system for movement by rolling along the carrying cable 11. In this case, the hauling cable 14 of FIG. 1 is eliminated.

Movement of the vehicle along the carrying cable 11 thus takes place either by traction by means of a hauling cable 14 in the case of a 2S or 3S cable car, or in autonomous manner by a self-propelled system integral to the vehicle.

The invention claimed is:

1. Cableway installation, comprising:

at least one carrying cable on which the vehicle rolls along the line between two terminals, support blocks provided in the terminals for supporting and guiding of said at least one carrying cable, and means for repositioning said at least one carrying cable to periodically renew the surface directly in contact with the support blocks, wherein the means for repositioning said at least one carrying cable are configured to make said at least one carrying cable rotate on the carrying cable's axis by angularly modifying the contact area according to the profile of the housing groove of the support blocks.

2. Cableway installation according to claim 1, wherein the angle of rotation for repositioning of said at least one carrying cable is comprised between 90° and 180°.

3. Cableway installation according to claim 1, wherein said at least one carrying cable is a closed cable of circular cross-section, partially salient from a housing groove and pressing on a contact area in the form of an arc of a circle of each support block.

4. Cableway installation according to claim 2, wherein repositioning of said at least one carrying cable is performed from the two terminals in simultaneous or staggered manner.

5. Cableway installation according to claim 1, wherein repositioning of said at least one carrying cable is performed by means of a hydraulic or mechanical actuating device, which is arranged in the terminals to produce the torque necessary for partial rotation of said at least one carrying cable.

6. Cableway installation according to claim 5, wherein the actuating device comprises a jaw system for clamping of said at least one carrying cable, said jaw system being fixed on a toothed wheel engaging with a pinion controlled by a mechanism.

7. Cableway installation according to claim 6, wherein said at least one carrying cable passes through the jaw system and is connected to an anchorage, which is configured to be free in rotation on the carrying cable's axis during the angular repositioning operation.

8. Method for repositioning a carrying cable on support and guide blocks of a cableway installation, said carrying cable being a closed cable secured by anchorages in terminals, comprising:

keeping the carrying cable taut during repositioning, making each end of said carrying cable rotate on the carrying cable's axis with an angle comprised between 90° and 180° to renew the contact area with a housing groove of the support and guide blocks, and monitoring the angular movement of said carrying cable in each terminal.

9. Method for repositioning a carrying cable according to claim 8, wherein:

the carrying cable is raised slightly for staggering the carrying cable from the bottom of the housing groove of the block, rolling means are inserted in a separating gap, and the carrying cable is temporarily placed on the rolling means before rotation is performed for repositioning of the carrying cable.

10. Method for repositioning a carrying cable according to claim 9, wherein the repositioning in rotation is performed in a direction compatible with that of a thread of cabling of the closed cable.

11. Method for repositioning a carrying cable according to claim 9, wherein the anchorages of the carrying cable in the terminals are configured to be mounted free in rotation when the repositioning is performed.

12. Method for repositioning a carrying cable according to claim 8, wherein movement of a vehicle along the carrying cable takes place either by traction by means of a hauling cable in the case of a 2S or 3S cable car, or in autonomous manner by a self-propelled system integral to the vehicle.

* * * * *